US006648186B2

(12) United States Patent
Roethel et al.

(10) Patent No.: US 6,648,186 B2
(45) Date of Patent: Nov. 18, 2003

(54) PUSH-BUTTON FAUCET

(75) Inventors: Henry G. Roethel, Ravenna, OH (US); Raymond P. Kawolics, Solon, OH (US); Michael H. Meyer, Sagamore Hills, OH (US)

(73) Assignee: The Meyer Company, Cleveland, OH (US)

( * ) Notice: Subject to any disclaimer, the term of this patent is extended or adjusted under 35 U.S.C. 154(b) by 0 days.

(21) Appl. No.: 10/074,891

(22) Filed: Feb. 13, 2002

(65) Prior Publication Data

US 2002/0108973 A1 Aug. 15, 2002

Related U.S. Application Data

(60) Provisional application No. 60/268,392, filed on Feb. 3, 2001.

(51) Int. Cl.[7] ..... B65D 47/00
(52) U.S. Cl. ..... 222/509; 222/511; 222/518
(58) Field of Search ..... 222/509, 511–514, 222/518, 336–338, 340, 341; 251/319–321, 339

(56) References Cited

U.S. PATENT DOCUMENTS

| | | | |
|---|---|---|---|
| 23,658 | A | 4/1859 | Bradford |
| 29,263 | A | 7/1860 | Flattery |
| 48,407 | A | 6/1865 | Jenkins |
| 520,436 | A | 5/1894 | Kirchner et al. |
| 549,678 | A | 11/1895 | Miller |
| 588,357 | A | 8/1897 | Rowe |
| 591,228 | A | 10/1897 | Goltermann |
| 950,801 | A | 3/1910 | Barr |
| 1,186,676 | A | 6/1916 | Osterbauer |
| 1,316,585 | A | 9/1919 | Logan |
| 1,722,103 | A | 7/1929 | McFarlan |
| 2,082,706 | A | 6/1937 | Maggiora |
| 2,083,156 | A | 6/1937 | McCabe |
| 2,197,352 | A | 4/1940 | Terkel |
| 2,526,363 | A | 10/1950 | Jones |

(List continued on next page.)

FOREIGN PATENT DOCUMENTS

| | | |
|---|---|---|
| DE | 917287 | 8/1954 |
| DE | 3403177 A | 1/1984 |
| FR | 1281635 | 12/1961 |
| FR | 1299762 | 6/1962 |
| GB | 251320 | 2/1920 |

(List continued on next page.)

OTHER PUBLICATIONS

United Kingdom Patent Office Search Report for corresponding U.K. Patent Application No. GB0203264.7, Aug. 16, 2002.

*Primary Examiner*—J. Casimer Jacyna
(74) *Attorney, Agent, or Firm*—Fay, Sharpe, Fagan, Minnich & McKee, LLP

(57) ABSTRACT

A faucet includes a body having an inlet, an inlet passageway connected to the inlet and outlet passageway that intersects the inlet passageway. The outlet passageway terminates at an outlet. A push-button actuator has a biasing portion that is located in the outlet passageway and a button portion that projects outwardly through an opening defined in the body. The button portion is normally biased into a first, extended position by the biasing portion and is selectively manually moveable to a second, operative position. A seal member is provided and is adapted to engage and seal the inlet to the inlet passageway. A stem projects from the seal member and is operably coupled to the button portion of the push-button actuator. The seal member is normally biased into sealing engagement with the inlet the by the biasing portion of the push-button actuator. The seal member is moveable out of sealing engagement with the inlet when the button portion of the push-button actuator is moved to its second, operative position.

20 Claims, 7 Drawing Sheets

U.S. PATENT DOCUMENTS

| | | | | | |
|---|---|---|---|---|---|
| 2,543,850 | A | | 3/1951 | Henricson | |
| 2,558,272 | A | | 6/1951 | Rubenstein et al. | |
| 2,579,977 | A | | 12/1951 | Sjolin | |
| 2,623,785 | A | | 12/1952 | Henchert | |
| 2,661,019 | A | | 12/1953 | Snyder et al. | |
| 2,704,548 | A | | 3/1955 | Ralston | |
| 2,876,794 | A | | 3/1959 | Reedy | |
| 2,906,430 | A | | 9/1959 | Henchert | |
| 3,049,263 | A | | 8/1962 | Edelstone et al. | |
| 3,061,196 | A | | 10/1962 | Bauerlein | |
| 3,069,841 | A | | 12/1962 | Moore | |
| 3,082,783 | A | | 3/1963 | Welty et al. | |
| 3,107,894 | A | | 10/1963 | Quinn | |
| 3,151,787 | A | | 10/1964 | Miller | |
| 3,187,965 | A | | 6/1965 | Bourget | |
| 3,207,388 | A | | 9/1965 | Waddington et al. | |
| 3,223,296 | A | | 12/1965 | Waddington et al. | |
| 3,236,424 | A | | 2/1966 | Ward | |
| 3,263,875 | A | | 8/1966 | Lofdahl | |
| 3,306,570 | A | | 2/1967 | Cooksley | |
| 3,308,224 | A | | 3/1967 | Waddington et al. | |
| 3,323,692 | A | | 6/1967 | Cook | |
| 3,329,164 | A | | 7/1967 | Symonds et al. | |
| 3,348,848 | A | | 10/1967 | Lucking et al. | |
| 3,376,582 | A | * | 4/1968 | Samuels | 222/488 |
| 3,378,035 | A | | 4/1968 | Waddington et al. | |
| 3,445,086 | A | | 5/1969 | Quinn | |
| 3,460,715 | A | | 8/1969 | Lane et al. | |
| 3,542,257 | A | | 11/1970 | Parish | |
| 3,584,834 | A | | 6/1971 | Reid et al. | |
| 3,595,445 | A | | 7/1971 | Buford et al. | |
| 3,666,150 | A | | 5/1972 | Liljeholm | |
| 3,730,224 | A | | 5/1973 | Prisk | |
| 3,731,851 | A | | 5/1973 | Rauh | |
| 4,034,917 | A | | 7/1977 | Bailey | |
| 4,105,141 | A | | 8/1978 | Lane et al. | |
| 4,440,316 | A | | 4/1984 | Christine | |
| 4,452,425 | A | | 6/1984 | Lucking | |
| 4,471,807 | A | | 9/1984 | Lucking et al. | |
| 4,475,566 | A | | 10/1984 | Haines | |
| 4,632,362 | A | | 12/1986 | Lucking | |
| 4,640,493 | A | | 2/1987 | Dudzik | |
| 4,660,748 | A | | 4/1987 | Hagan | |
| 4,687,123 | A | | 8/1987 | Hyde | |
| 4,905,875 | A | | 3/1990 | Straiton | |
| 5,102,017 | A | | 4/1992 | Dirksing | |
| 5,211,313 | A | | 5/1993 | Lucking et al. | |
| 5,337,775 | A | | 8/1994 | Lane et al. | |
| 5,447,257 | A | | 9/1995 | Dark | |
| 5,615,808 | A | * | 4/1997 | Huang | 222/472 |
| 6,138,878 | A | | 10/2000 | Savage et al. | |
| 2002/0079001 | A1 | | 6/2002 | Blackbourn et al. | |

FOREIGN PATENT DOCUMENTS

| | | |
|---|---|---|
| GB | 694394 | 7/1953 |
| GB | 735459 | 8/1955 |
| GB | 1525630 | 9/1978 |
| GB | 2 096 284 A | 10/1982 |
| GB | 2 101 275 A | 1/1983 |
| GB | 2 138 109 A | 10/1984 |
| GB | 2 138 544 A | 10/1984 |
| IT | 461344 | 2/1950 |

* cited by examiner

PUSH-BUTTON FAUCET

CROSS-REFERENCE TO RELATED APPLICATION

This application claims priority from and hereby expressly incorporates by reference U.S. provisional application No. 60/268,392 filed Feb. 13, 2001.

BACKGROUND OF THE INVENTION

Faucets for dispensing liquid from bag-in-box or similar containers are well-known and in widespread use. To achieve commercial success, these faucets must be low-cost, reliable, easy-to-use (even with one hand) and provide adequate flow. While suitable faucets of this type are commercially available, a need has been identified for an improved faucet that provides superior performance and cost-effectiveness.

SUMMARY OF THE INVENTION

In accordance with a first aspect of the present invention, a faucet comprises a body including an inlet passageway having an inlet and an outlet passageway that intersects the inlet passageway. The outlet passageway terminates at an outlet. A push-button actuator has a biasing portion located in the outlet passageway and a button portion that projects outwardly through an opening defined in the body. The button portion is normally biased into a first, extended position by the biasing portion and is selectively manually movable to a second, operative position. A seal member is provided and is adapted to engage and seal the inlet to the inlet passageway. A stem projects from the seal member and is operably coupled to the button portion of the push-button actuator. In this manner, the seal member is normally biased into sealing engagement with the inlet by the biasing portion of the push-button actuator. The seal member is movable out of sealing engagement with the inlet when the button portion of the push-button actuator is moved to its second, operative position.

In accordance with another aspect of the present invention, a faucet comprises a body having an inlet, an inlet passageway extending from the inlet, an outlet, and an outlet passageway extending from the outlet and connecting with the inlet passageway. The faucet further comprises a seal adapted for engaging and sealing the inlet. A stem is connected to the seal and projects into the inlet passageway. An actuator is provided an includes a first portion that projects outwardly from the body and a second portion that exerts a biasing force on the first portion that normally urges the first portion to an extended position. The first portion of the actuator is manually movable to an operative position against the biasing force. The stem and seal are operably coupled to the first portion of the actuator and movable therewith. The seal blocks the inlet when the first portion of the actuator is in the extended position. The seal is moved away from the inlet to allow fluid flow into the inlet when the first portion of the actuator is moved to the operative position.

In accordance with another aspect of the present invention, a faucet comprises a body adapted for being secured to an associated fluid container. The body includes an inlet, an inlet passageway that communicates with the inlet, an outlet, and an outlet passageway that communicates with both the outlet and the inlet passageway. The faucet further comprises an actuator that is selectively movable between first and second positions. The faucet also comprises a biasing member that normally urges the actuator into its first position. The faucet includes a seal member operably coupled to and movable with the actuator. The seal member is sealingly engaged with the inlet when said actuator is in its first position and is moved out of sealing engagement with the inlet when the actuator is moved to its second position.

One advantage of the present invention resides in the provision of a new and improved faucet.

Still other benefits and advantages of the present invention will become apparent to those of ordinary skill in the art to which the invention pertains upon reading this specification.

BRIEF DESCRIPTION OF THE DRAWINGS

A faucet formed in accordance with the present invention comprises various components and arrangements of components, a preferred embodiment of which is illustrated in the accompanying drawings that form a part hereof and wherein.

DETAILED DESCRIPTION OF THE INVENTION

Figure 2:
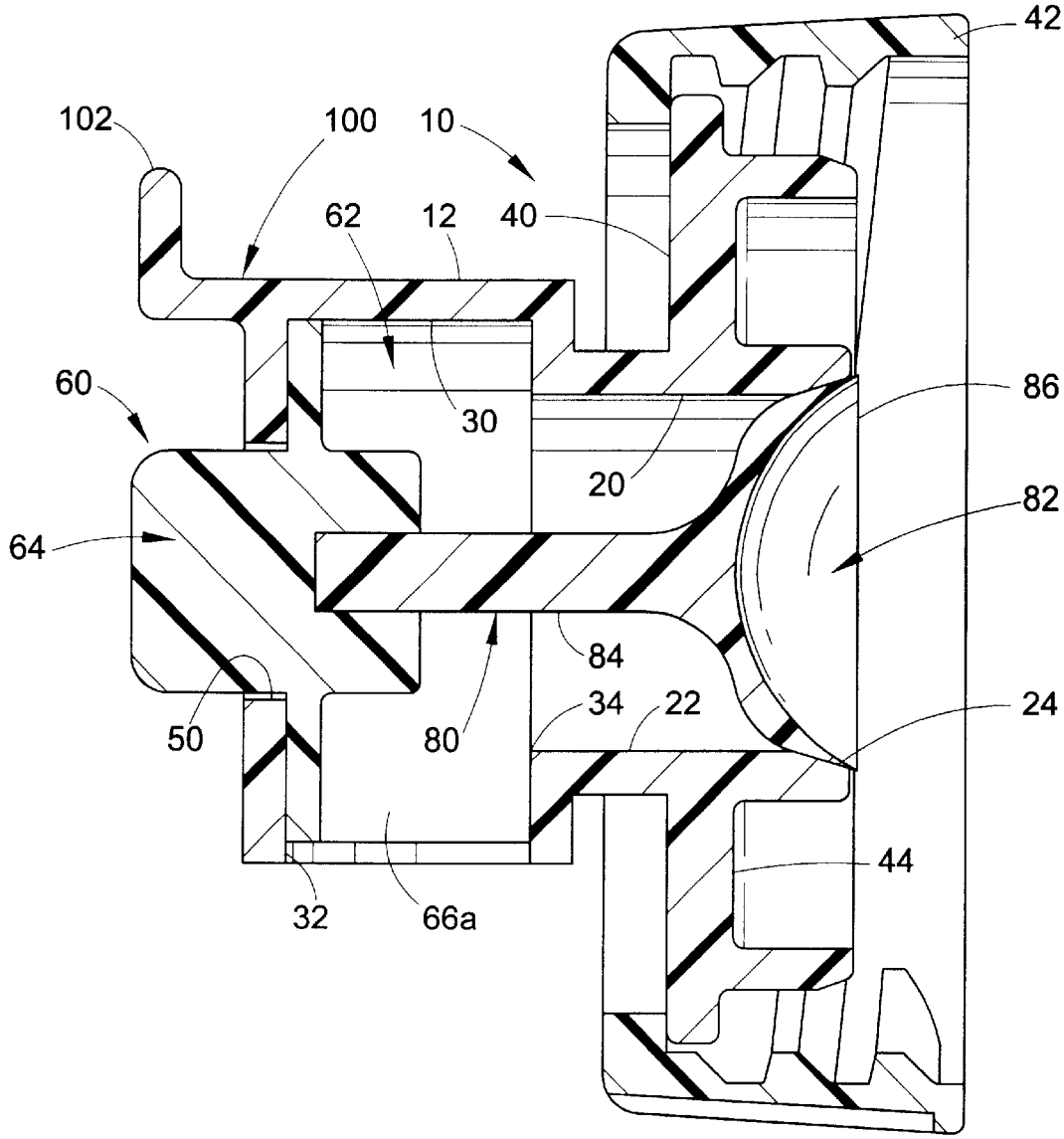
FIG. 2 is a sectional view taken along line 2—2 of FIG. 1.

Referring now to the drawings, a faucet formed in accordance with the present invention is shown generally at 10. The faucet 10 comprises a body 12 that is preferably defined from molded plastic although any other suitable material such as metal may be used. With reference to FIG. 2, the body 12 comprises an inlet passageway 20 and an inlet 22 to the inlet passageway 20. The inlet passageway 20 is preferably cylindrical. The body 12 also defines a blind outlet passageway 30 that opens in an outlet 32. The outlet passageway 30 is preferably defined to be partially cylindrical such as semi-cylindrical illustrated herein.

The inlet passageway 22 intersects the outlet passageway at a port 34. Thus, the inlet 22 is in fluid communication with the outlet 32. The inlet 22 preferably diverges or flares radially outwardly moving away from the port 34 so that a valve seat 24 is defined.

The body 12 is adapted for fluid-tight fixed securement to an associated outlet of a bag-in-box container or other fluid container, with the inlet 22 in fluid communication with the interior of the container so that liquid is dispensed from the container through the faucet. Any suitable connection between the body 12 and the associated container may be utilized. In the illustrated embodiment, for example, the body 12 defines a flange 40 that projects outwardly therefrom. A nut 42 abuts the flange 40 and is rotatable relative thereto. The nut 42 is adapted for threaded securement to an associated outlet fitment of the associated container. Most preferably, the body 12 defines an annular groove or recess 44 that receives a peripheral portion of the associated outlet fitment therein when the faucet body 12 is threadably secured to the associated fitment to ensure proper alignment of the body 12 with the associated fitment.

The body 12 also defines an access opening 50 that is generally aligned with and opposite the port 34. In the illustrated embodiment, the access opening 50 is circular and coaxial with the port 34. An actuator such as a push-button actuator 60 is secured to the body 12. The push-button actuator 60 includes a biasing portion 62 located in the blind bore 30 and a button portion 64 connected to the biasing portion 62 and that projects outwardly through the access opening 50. The push-button actuator 60 is preferably defined as a one-piece construction from a resilient elastomeric material such as silicone or another suitable resilient material.

Figure 3:
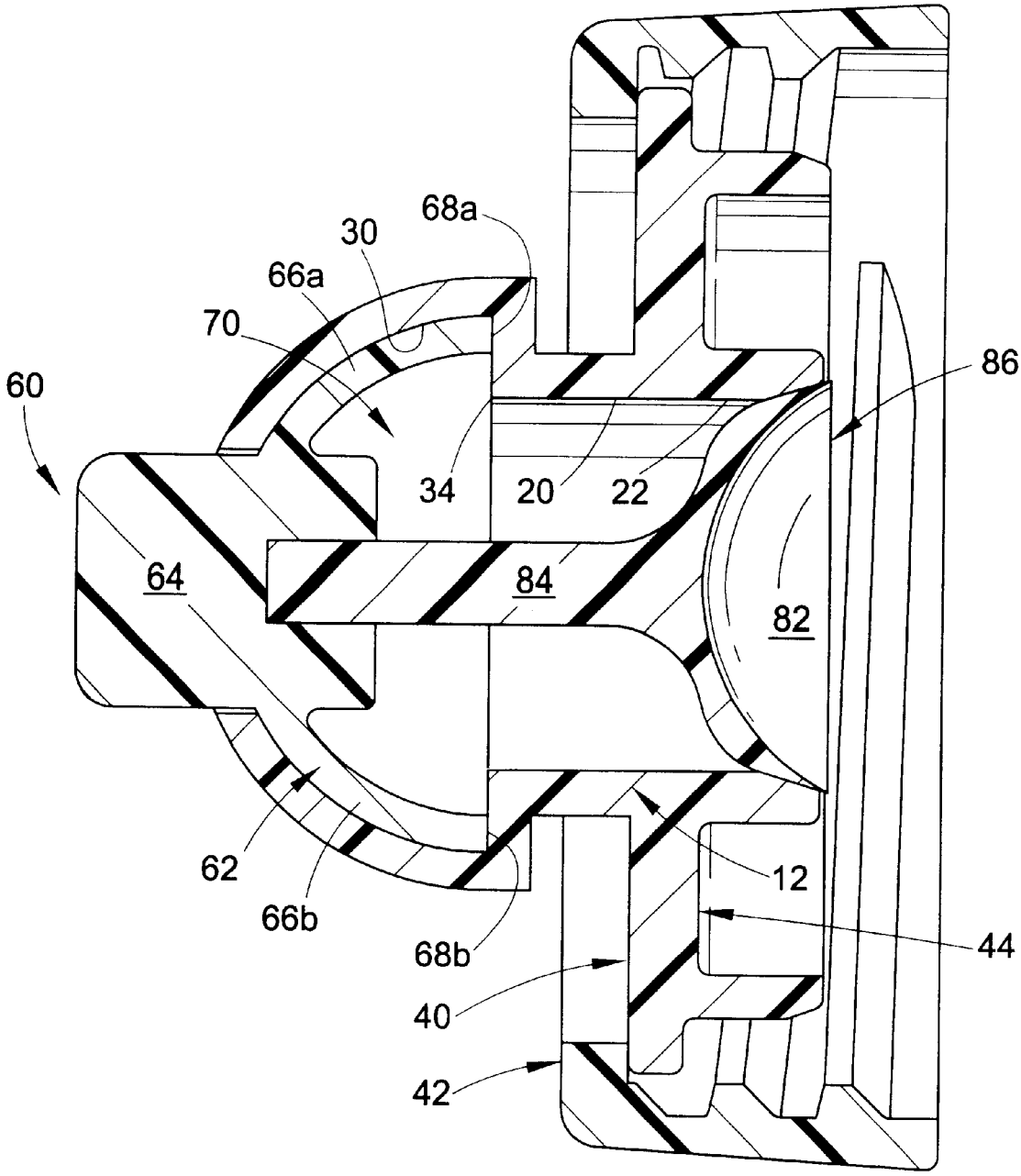
FIG. 3 is a sectional view taken along line 3—3 of FIG. 2.
Figure 4:
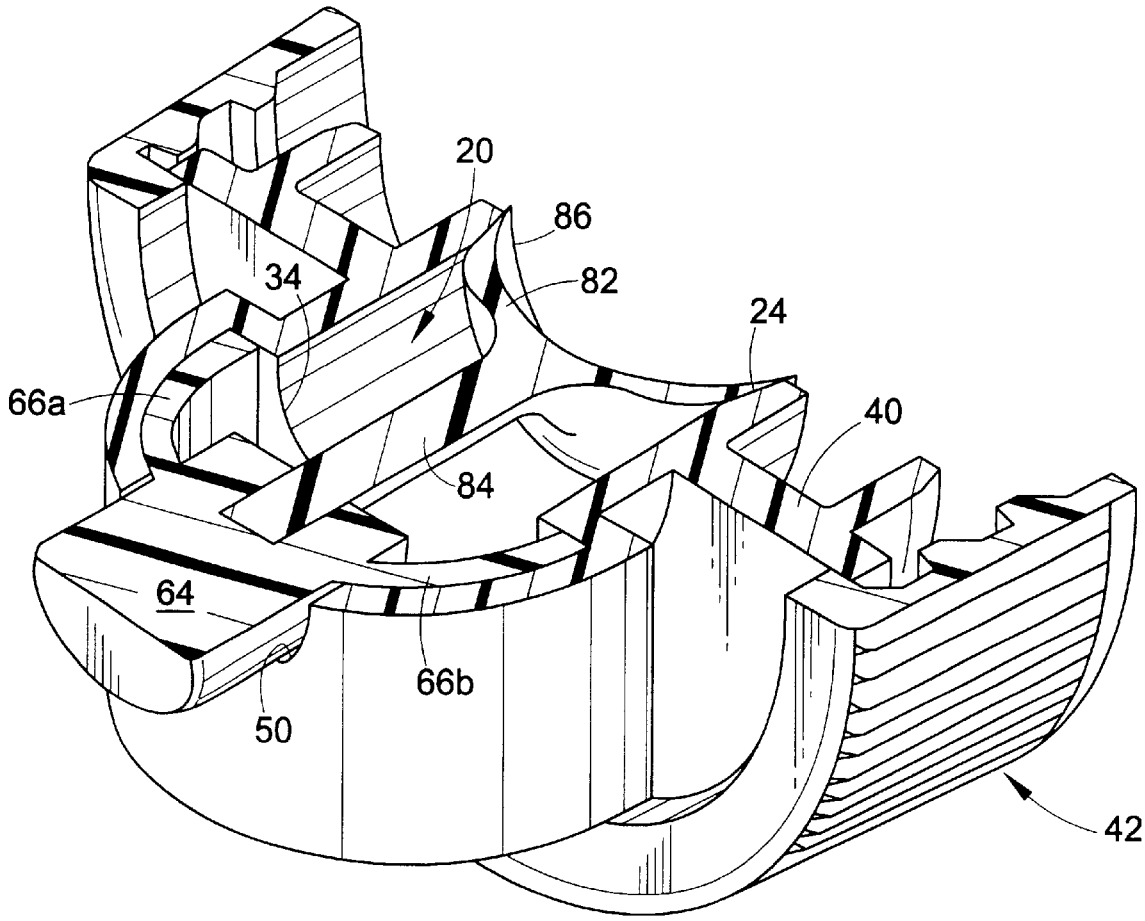
FIG. 4 is a perspective view of the faucet section shown in FIG. 3.
Figure 5:
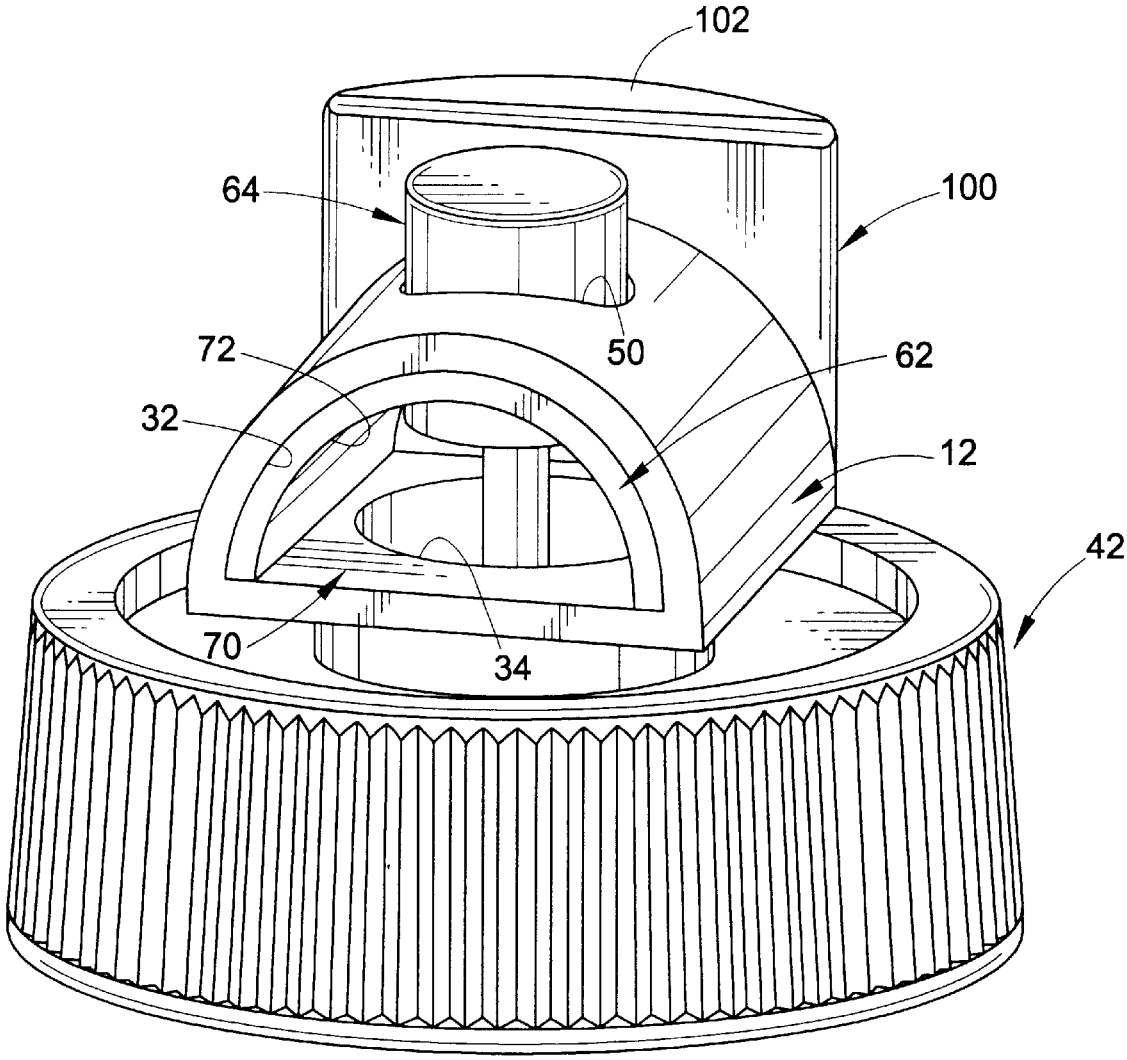
FIG. 5 is a second perspective view of the faucet shown in FIG. 1.

As may be seen most clearly with reference to FIGS. 3–5, the biasing portion 62 of the push-button actuator 60 is dimensioned and conformed for close receipt in the blind bore 30 to prevent fluid flow between the biasing portion of the actuator and the body 12. In the preferred arrangement, the biasing portion 62 defines a partially cylindrical arcuate conformation comprising first and second arcuate legs 66*a*, 66*b* that terminate at respective opposite ends 68*a*,68*b*. These opposite ends 68*a*, 68*b* abut the body 12 on opposite sides of the port 34. A passage 70 is defined between the port 34 and the legs 66*a*,66*b* in the blind bore 30. The passage 70 defines an outlet 72 that communicates with the outlet 32 of the blind bore 30. Owing to the close fit between the biasing portion 62 and the body portion defining the blind bore 30, fluid moving from the port 34 into the passage 70 flows only to the outlet 72 only and is prevented from flowing between the legs 66*a*,66*b* and the body 12 as would potentially result in fluid leakage from the access opening 50 adjacent the push-button 64.

Figure 6:
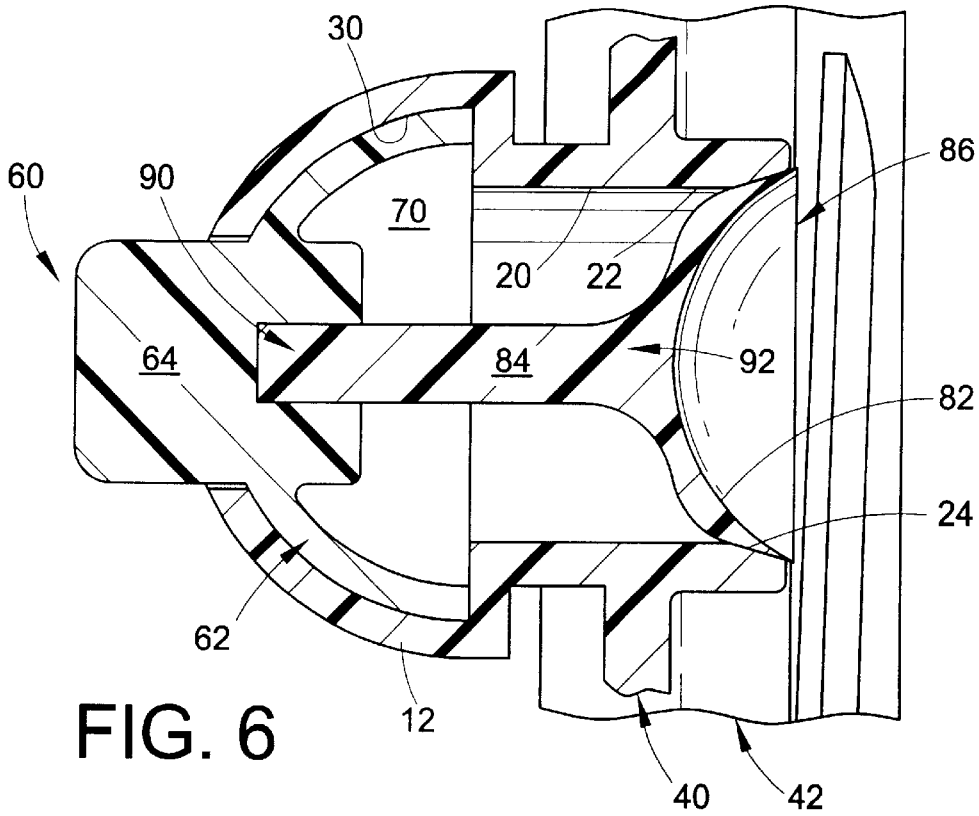
FIG. 6 is a view similar to FIG. 3 showing the push-button actuator in a first operative position; and, FIG. 7 is a view similar to FIG. 6 showing the push-button actuator in a second operative position.
Figure 7:
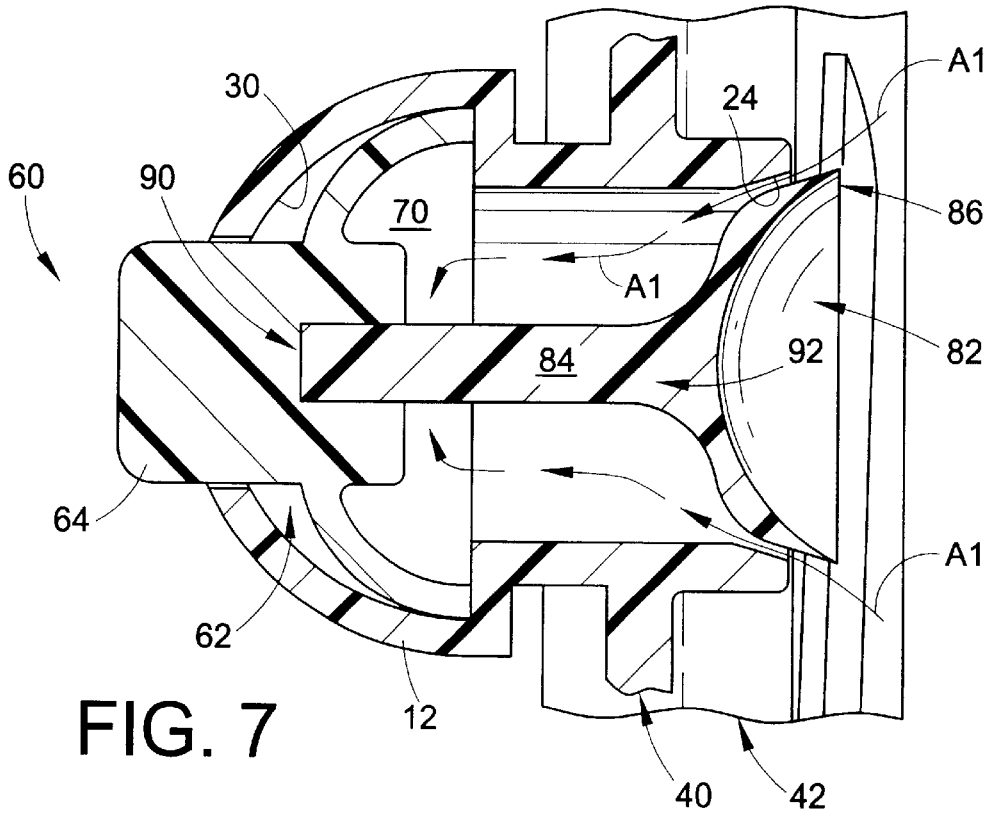

As also shown in FIG. 6, the legs 66*a*,66*b* of the biasing portion 62 normally resiliently bias the push-button actuator 60 into the illustrated first position, wherein the legs 66*a*, 66*b*, along their full length, are shaped to conform with and abut the adjacent portion of the body 12 that defines the bore 30 and wherein the push-button 64 is fully extended through the access opening 50. Exertion of manual pressure on the push-button 64 toward the port 34 results in the legs 66*a*,66*b* resiliently deforming as shown in FIG. 7 so that the push-button 64 and a portion of the legs 66*a*,66*b* adjacent the push-button move to a second operative position. Upon termination of the manual pressure on the push-button 64, the natural resiliency of the legs 66*a*,66*b* urges the push-button 64 and legs 66*a*,66*b* back to the first operative position as shown in FIG. 6.

The faucet 10 includes a stem/seal member 80 operably coupled to the push-button 64 for movement therewith between the first and second positions. More particularly, the stem/seal member 80 is preferably a one-piece construction of molded resilient plastic such as silicone or the like that comprises a diaphragm seal portion 82 and an elongated stem portion 84 projecting outwardly from the seal portion 82. A peripheral edge 86 of the seal portion 84 is tapered for added flexibility and is adapted to mate in a fluid-tight manner with the seat 24 as shown in FIGS. 2–4 and 6.

The stem portion 84 extends centrally through the inlet bore 20 and port 34 and a first end 90 thereof is fixedly secured to the push-button 64 by adhesive or the like. The end 90 of the stem can include or define ribs or the like that mate with corresponding ribs or the like or a plain-sided bore defined in the push-button 64 to strengthen the connection between the end 90 of the stem and the push-button 64. A second end 92 of the stem portion 84 is connected to or defines a seal portion 82. The second end 92 of the stem portion preferably joins the seal portion 82 at the center of the seal portion. In the preferred embodiment, the inlet 22, seat 24 and seal peripheral edge 86 are circular, and the second end 92 of the stem portion 84 is centrally connected to the seal portion 82.

Operation of the faucet 10 is readily apparent with reference again to FIGS. 6 and 7. When the push-button actuator 60 is in the first operative position as shown in FIG. 6, the biasing force of the legs 66*a*,66*b* pulls the stem/seal member 80 into the inlet passageway 20 toward the actuator 60 so that the peripheral edge 86 of the seal portion 82 sealingly engages the seat 24 and prevents fluid flow from the bag-in-box or other associated container into the inlet passageway 22. The illustrated recessed or dished shape of the seal portion 82 is preferred in that fluid pressure exerted on the seal portion by fluid held in the associated container also urges the peripheral edge 86 into sealing engagement with the seat 24.

When the push-button 64 is moved manually to its second operative position, this axial movement of the push-button 64 is transferred to the seal portion 82 through the stem 84 so that the peripheral edge 86 is lifted away from the seat 24 as shown in FIG. 7. With the seal portion 82 separated from the seat 24, fluid flows by gravity or other force from the associated container past the seat 24 and into the inlet passageway 20 as shown by the arrows A1. Fluid that flows into the inlet passageway 20 flows through the port 34, into the passage 70 and out of the faucet through the outlets 32,72 by gravity or pressure. When manual pressure on the push-button 64 is released, the push-button returns to its normal, first operative position and pulls the seal portion 84 into sealing engagement with the seat 24 to prevent further fluid flow through the faucet 10.

Figure 1:
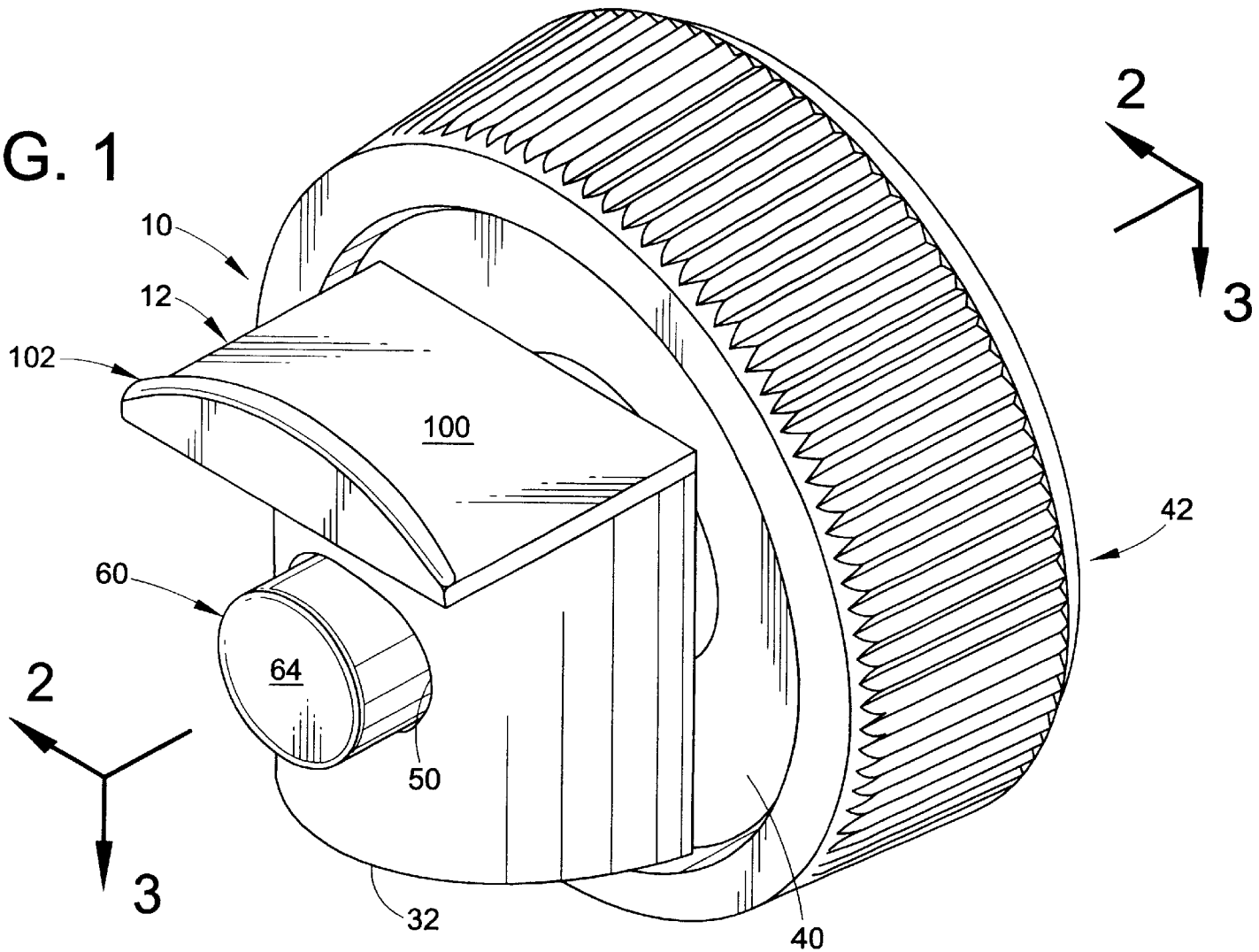
FIG. 1 is a first perspective view of a push-button faucet formed in accordance with the present invention.
Figure 1A:
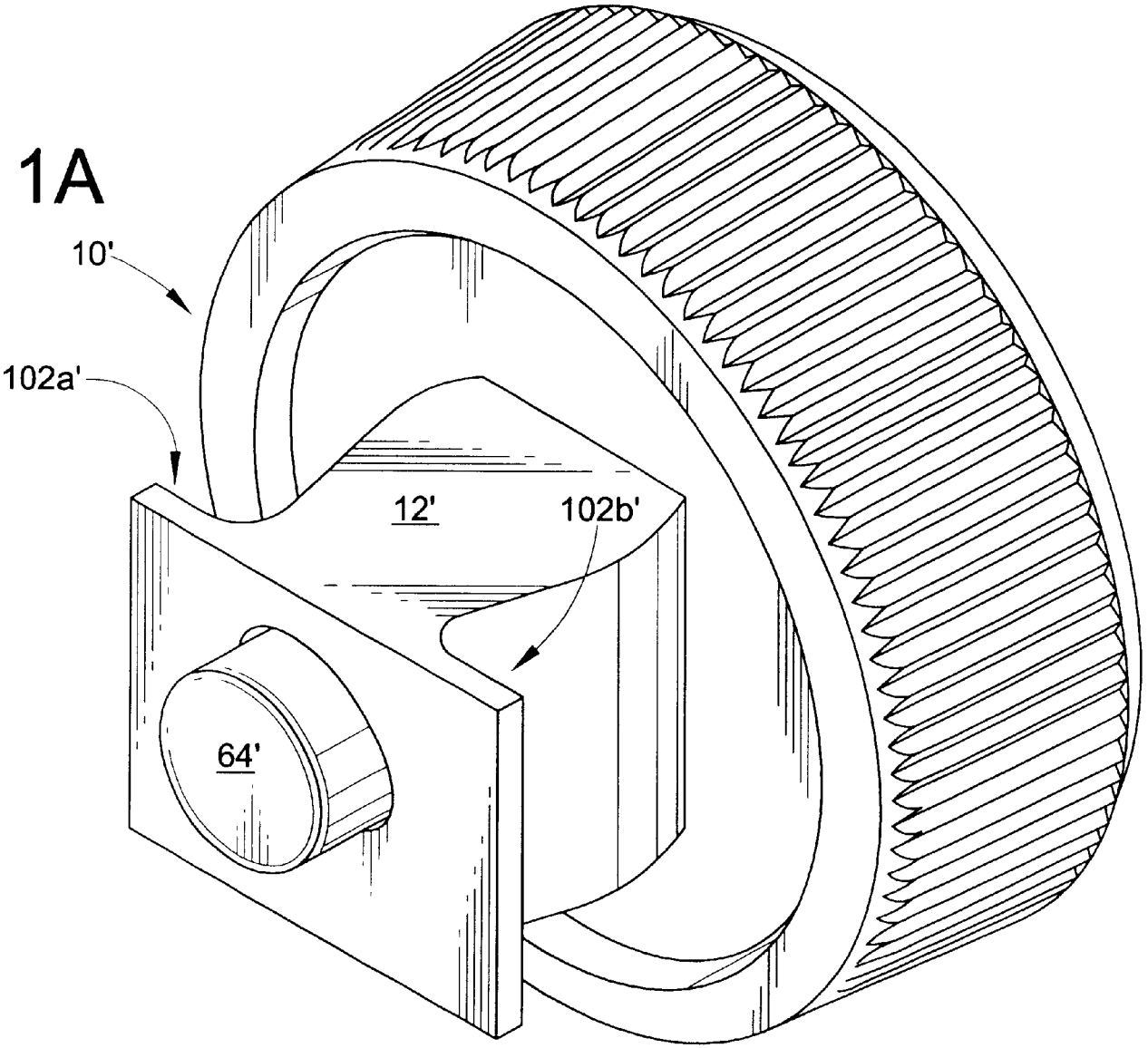
FIG. 1A is a perspective view of a push-button faucet formed in accordance with an alternative embodiment of the present invention.

To facilitate one-handed application of manual pressure on the push-button 64, the body 12 preferably defines one or more gripping members 100, including a lip 102 or the like, projecting outwardly therefrom adjacent the access opening 50. The one or more gripping member provide a grip for a user's fingers when his/her thumb is used to move the push-button 64 to its second operative position. FIG. 1A illustrates an alternative faucet 10'. Except as otherwise shown and described, the faucet 10' illustrated in FIG. 1A is identical to the faucet 10 illustrated in FIG. 1. The faucet 10' includes a body 12' that defines first and second lips 102*a*', 102*b*' located respectively on opposite lateral sides of the push-button 64' to provide a grip for a user's fingers while the user's thumb is used to depress the push-button 64'.

The invention has been described with reference to preferred embodiments. Modifications and alterations may occur to others upon reading the preceding specification. It is intended that the invention be construed as including all such modifications and alterations insofar as they are encompassed by the appended claims as construed literally and/or according to the doctrine of equivalents.

Having thus described the preferred embodiments, what is claimed is:

1. A faucet comprising:

a body including an inlet passageway comprising an inlet and an outlet passageway that intersects the inlet passageway, said outlet passageway comprising an outlet;

a push-button actuator comprising a biasing portion located in said outlet passageway and a button portion that projects outwardly through an opening defined in said body, said button portion normally biased into a first, extended position by said biasing portion and selectively manually movable to a second, operative position, wherein said biasing portion is defined as a resilient elastomeric structure that abuts and conforms in shape to a portion of said body that defines said outlet passageway when said button portion is located in said first, extended position;

a seal member adapted to engage and seal said inlet;

a stem projecting from said seal member and operably coupled to said button portion of said push-button actuator whereby said seal member is normally biased into sealing engagement with said inlet by said biasing portion of said push-button actuator, said seal member movable out of sealing engagement with said inlet when said button portion of said push-button actuator is moved to said second, operative position.

2. The faucet as set forth in claim 1, wherein said biasing portion of said push-button actuator and said outlet passageway cooperate to define a liquid-flow passage that communicates with said outlet of said body.

3. The faucet as set forth in claim 1, wherein said stem and said seal member are defined together as a one-piece construction.

4. A faucet comprising:

a body comprising: (i) an inlet passageway including an inlet; and, (ii) an outlet passageway that intersects the inlet passageway, said outlet passageway including an outlet;

a push-button actuator comprising: (i) a biasing portion located in said outlet passageway; and, (ii) a button portion that projects outwardly through an opening defined in said body, said button portion normally biased into a first, extended position by said biasing portion and selectively manually movable to a second, operative position;

a seal member adapted to engage and seal said inlet;

a stem projecting from said seal member and operably coupled to said button portion of said push-button actuator so that said seal member is normally biased into sealing engagement with said inlet by said biasing portion of said push-button actuator, said seal member movable out of sealing engagement with said inlet when said button portion of said push-button actuator is moved to said second, operative position;

wherein:

said biasing portion of said push-button actuator and said outlet passageway cooperate to define a liquid-flow passage that communicates with said outlet of said body; and, said body defines a port at an intersection of said outlet passageway and said inlet passageway, and wherein said biasing portion of said push-button actuator comprises first and second legs that contact said body on opposite sides of said port.

5. The faucet as set forth in claim 4, wherein said stem extends through said inlet passageway and said port.

6. The faucet as set forth in claim 5, wherein said first and second legs define said biasing portion of said push-button actuator to be arcuate in shape.

7. A faucet comprising:

a body comprising: (i) an inlet passageway including an inlet; and, (ii) an outlet passageway that intersects the inlet passageway, said outlet passageway comprising an outlet;

a push-button actuator comprising: (i) a biasing portion located in said outlet passageway; and, (ii) a button portion that projects outwardly through an opening defined in said body, said button portion normally biased into a first, extended position by said biasing portion and selectively manually movable to a second, operative position, wherein said button portion and said biasing portion of said push-button actuator are defined together as a one-piece construction;

a seal member adapted to engage and seal said inlet;

a stem projecting from said seal member and operably coupled to said button portion of said push-button actuator so that said seal member is normally biased into sealing engagement with said inlet by said biasing portion of said push-button actuator, said seal member movable out of sealing engagement with said inlet when said button portion of said push-button actuator is moved to said second, operative position.

8. A faucet comprising:

a body comprising an inlet, an inlet passageway extending from said inlet, an outlet, and an outlet passageway extending from said outlet and connecting with said inlet passageway;

a seal adapted for engaging and sealing said inlet;

a stem connected to said seal and projecting into said inlet passageway;

an actuator comprising a first portion that projects outwardly from said body and a second portion that exerts a biasing force on said first portion that normally urges said first portion to an extended position, said first portion of said actuator manually movable to an operative position against said biasing force, said stem and said seal operably coupled to said first portion of said actuator and movable therewith, said seal blocking said inlet when said first portion of said actuator is in said extended position and moved away from said inlet to allow fluid flow into said inlet when said first portion of said actuator is moved to said operative position, wherein said second portion of said actuator comprises a resilient elastomeric conformation located in said outlet passageway, and wherein said second portion of said actuator abuts and conforms in shape to said outlet passageway when said first portion of said actuator is located in said extended position.

9. The faucet as set forth in claim 8, wherein said second portion of said actuator is located in said outlet passageway.

10. The faucet as set forth in claim 9, wherein a fluid passage is defined between said second portion of said actuator and a portion of said body that defines said outlet passageway.

11. The faucet as set forth in claim 10, wherein said second portion of said actuator comprises a partially cylindrical portion.

12. The faucet as set forth in claim 8, wherein said seal includes a circular periphery.

13. The faucet as set forth in claim 12, wherein said circular periphery of said seal tapers moving radially outward.

14. The faucet as set forth in claim 12, wherein said stem is connected to a center of said seal.

15. A faucet comprising:

a body comprising an inlet, an inlet passageway extending from said inlet, an outlet, and an outlet passageway extending from said outlet and connecting with said inlet passageway;

a seal adapted for engaging and sealing said inlet;

a stem connected to said seal and projecting into said inlet passageway;

an actuator comprising a first portion that projects outwardly from said body and a second portion that exerts a biasing force on said first portion that normally urges said first portion to an extended position, said first portion of said actuator manually movable to an operative position against said biasing force, said stem and said seal operably coupled to said first portion of said actuator and movable therewith, said seal blocking said inlet when said first portion of said actuator is in said extended position and moved away from said inlet to allow fluid flow into said inlet when said first portion of said actuator is moved to said operative position, wherein:

said second portion of said actuator is located in said outlet passageway;

a fluid passage is defined between said second portion of said actuator and a portion of said body that defines said outlet passageway; and, said first and second portions of said actuator are defined as a one-piece construction.

16. A faucet comprising:

a body adapted for being secured to an associated fluid container, said body including an inlet, an inlet passageway that communicates with said inlet, an outlet, and an outlet passageway that communicates with both said outlet and said inlet passageway;

an actuator selectively movable between first and second positions;

a biasing member normally urging said actuator into said first position, said biasing member located in said outlet passageway and comprising first and second resilient legs that conform in shape to said outlet passageway when said actuator is located in said first position;

a seal member operably coupled to and movable with said actuator, said seal member sealingly engaged with said inlet when said actuator is in said first position and moved out of sealing engagement with said inlet when said actuator is moved to said second position.

17. The faucet as set forth in claim 16, wherein said seal member is operably connected to said actuator by a stem that is operably coupled to both said seal member and said actuator and that extends through said inlet passageway.

18. The faucet as set forth in claim 16, wherein said outlet passageway is oriented transversely relative to said inlet passageway.

19. The faucet as set forth in claim 16, wherein said actuator and said biasing member are defined as a one-piece construction.

20. A faucet comprising:

a body adapted for being secured to an associated fluid container, said body including an inlet, an inlet passageway that communicates with said inlet, an outlet, and an outlet passageway that communicates with both said outlet and said inlet passageway;

an actuator selectively movable between first and second positions; a biasing member normally urging said actuator into said first position, said biasing member and said actuator defined together as a one-piece construction, wherein said biasing member is located in said outlet passageway;

a seal member operably coupled to and movable with said actuator, said seal member sealingly engaged with said inlet when said actuator is in said first position and moved out of sealing engagement with said inlet when said actuator is moved to said second position.

* * * * *

UNITED STATES PATENT AND TRADEMARK OFFICE

CERTIFICATE OF CORRECTION

PATENT NO. : 6,648,186 B2
DATED : November 18, 2003
INVENTOR(S) : Henry G. Roethel et al.

It is certified that error appears in the above-identified patent and that said Letters Patent is hereby corrected as shown below:

Title page,
Item [60], Related U.S. Application Data, should read as follows:
-- [60] Provisional application No. 60/268,392 filed on February 13, 2001 --

Signed and Sealed this

Fourth Day of May, 2004

JON W. DUDAS
*Acting Director of the United States Patent and Trademark Office*